US007488274B1

(12) United States Patent
Sears

(10) Patent No.: US 7,488,274 B1
(45) Date of Patent: Feb. 10, 2009

(54) AQUATIC EXERCISE PLATES AND AQUA THERAPY SYSTEM

(76) Inventor: Frank W. Sears, 10510 Six Pines, Apt. 3206, The Woodlands, TX (US) 77380

( * ) Notice: Subject to any disclaimer, the term of this patent is extended or adjusted under 35 U.S.C. 154(b) by 0 days.

(21) Appl. No.: 11/715,236

(22) Filed: Mar. 6, 2007

Related U.S. Application Data

(60) Provisional application No. 60/779,362, filed on Mar. 6, 2006.

(51) Int. Cl.
*A63B 31/00* (2006.01)

(52) U.S. Cl. ..... 482/55; 482/52

(58) Field of Classification Search ..... 482/44–50, 482/55, 148
See application file for complete search history.

(56) References Cited

U.S. PATENT DOCUMENTS 2,109,129 A * 2/1938 Fawcett et al. ..... 202/205
2,227,825 A * 1/1941 Devermann ..... 441/56
2,569,200 A 9/1951 Smith
3,397,414 A * 8/1968 Webb ..... 441/56
3,913,907 A 10/1975 Baker
4,480,829 A 11/1984 Yacoboski
4,509,744 A 4/1985 Beasley
4,565,369 A 1/1986 Bedgood
4,632,387 A * 12/1986 Guzman ..... 482/111
4,685,667 A * 8/1987 McDonald ..... 482/111
D367,089 S * 2/1996 Hughes et al. ..... D21/678
5,899,444 A * 5/1999 Rempe ..... 269/3

* cited by examiner

*Primary Examiner*—Lori Amerson
(74) *Attorney, Agent, or Firm*—Kenneth A. Roddy

(57) ABSTRACT

A set of generally rectangular flat plates for aquatic exercise that create drag when moved through a body of water. Each flat plate is provided with an arcuate finger slot for receiving the user's four fingers and an aperture for receiving their thumb. The finger slot and thumb aperture are strategically located such that when the plate is gripped, the center of the palm of the user's hand lays over the center of the flat plate on one side and the fingers and thumb are folded over to engage the opposite side and the user's forearm lays parallel to and over the longitudinal center line of the flat plate. Drag produced by moving the flat plate through the water is transferred to the center of the flat plate and the center of that force passes through the center of the palm of the hand.

2 Claims, 2 Drawing Sheets

AQUATIC EXERCISE PLATES AND AQUA THERAPY SYSTEM

CROSS REFERENCE TO RELATED APPLICATION

This application claims priority of U.S. Provisional Patent Application Ser. No. 60/779,362 Filed Mar. 6, 2006.

BACKGROUND OF THE INVENTION

1. Field of the Invention

This invention relates generally to aquatic exercise apparatus, and more particularly to a set of flat plates for aquatic exercise that create drag when used in water, such as a swimming pool, to resist muscle contraction or movement, and sets of the plates having surface areas of different size in a system to provide therapeutic beneficial effects of aerobic, anaerobic, and combined exercises.

2. Background Art

Aquatic exercise devices that create drag in when pushed or pulled through a body of water, such as a swimming pool, are known in the art. Most prior art aquatic exercise devices have wrist straps, appendage handgrips, and valve adjustments for changing drag, making them overly complicated and expensive to manufacture. The retail cost of some of these items is relatively high and may prevent a large number of people from purchasing and using them and, therefore not obtaining the benefits offered by an aquatic exercise device. The following are patents directed toward various aquatic exercise devices of the prior art:

U.S. Pat. No. 2,569,200, issued Sep. 25, 1951 to Emerson V. Smith, discloses a flat relatively small swimming paddle having parallel lateral sides, a rounded top or front edge, a bottom edge having a central inwardly curved cut away portion to form a palm and wrist opening, and an arcuate finger opening disposed a short distance above the cut away palm and wrist opening. The central inwardly curved cut away palm and wrist opening is of sufficient width to provide clearance of the thumb of the user's hand. Although the Smith swimming paddle may be suitable for use as aid in swimming, it does not provide any surface for receiving the palm and a portion of the forearm of the user, and would not be suitable for resistance exercises, since it has very little surface area to provide drag, no support surface for the user's palm and forearm, would be difficult to maintain a grip when moved through the water, and the grip would provide no lateral stability or longitudinal stability of the paddle as it is moved through the water.

U.S. Pat. No. 3,913,907, issued Oct. 21, 1975, to Charles O. Baker discloses an aquatic exercise device which includes a handgrip, a wrist strap, and an adjustable valve member to vary the surface area. All of these items would increase production time and cost.

U.S. Pat. No. 4,480,829, issued Nov. 6, 1984 to Anton Yacoboski, discloses an exercising and body toning device known commercially as the Aquaflex®, fitness paddles which comprise a handle with circular resistance members fixed on opposite ends thereof. Each resistance member comprises a pair of co-axial discs with sector openings therethrough so that they may be fixed in selected relative angular positions, with the openings in adjusted registration to adjust the resistance of movement of the device through water.

U.S. Pat. No. 4,509,744, issued Apr. 9, 1985 to Robert L. Beasley discloses an aquatic exercise device marketed by Aqua-gym®, comprising a substantially rectangular, flat rigid fluid resistance member having a U-shaped hand gripping member disposed in adjustably fixed spaced relation relative to the surface of the flat fluid resistance member, a wrist guide including a flat rigid stability member extending in a coplanar relation relative to the fluid resistance member to engage the user's wrist, and a J-shaped axial alignment member extending from one longitudinal edge of the rigid stability member to receive the user's wrist such that the user grasps the U-shaped hand gripping member while placing his wrist within the J-shaped axial alignment member.

U.S. Pat. No. 4,565,369, issued Jan. 21, 1986 to Douglas H. Bedgood, known commercially as the Aquatoner®, discloses a variable resistance aquatic exercising device for subjecting arms, legs and associated parts of a user's body to desired degrees of stress as the user moves his arms or legs through a body of water. The device has a handle and a plurality of flat, elongate fan-shaped panels disposed in stacked relation to each other, each having a mounting aperture through its center. A bolt extends through the apertures and adjustably attaches the panels to the handle. Spacers are positioned between adjacent panels to permit fluid flow between the panels and to protect the surfaces of the panels. The exercising device also has a flexible and adjustable mounting strap, disposed opposite the handle and attached to the panels.

U.S. Pat. No. 4,632,387, issued Dec. 30, 1986 to Horacio J. Guzman, discloses exercise enhancing devices attached to the foot and leg of a person to enable selective development of the muscles in aquatic environment. The devices are provided with adjustable vent apertures that enable adjustment of the water resistance to movement of the device to achieve compatibility with the desires of the user. A body support device releasably attachable to the side of a swimming pool enables the devices to enhance torso or abdominal exercises in order that a complete workout of all or selected body muscles may be achieved.

U.S. Pat. No. 4,685,667, issued Aug. 11, 1987, to Malcom C. McDonald discloses an aquatic exercise system which includes a round water resistance device with a hand grip opening in the center. If this device were cut out of rectangular sheets it would have a high cost per unit of drag produced.

The present invention is distinguished over the prior art in general, and these patents in particular by a set of generally rectangular flat plates for aquatic exercise that create drag when moved through a body of water. Each flat plate is provided with an arcuate finger slot for receiving the user's four fingers and an aperture for receiving their thumb. The finger slot and thumb aperture are strategically located such that when the plate is gripped, the center of the palm of the user's hand lays over the center of the flat plate on one side and the fingers and thumb are folded over to engage the opposite side. This feature allows the drag produced by moving the flat plate through the water to be transferred to the center of the flat plate, and the thumb aperture allows larger flat plates to be used to provide increased surface area. Another additional advantage of the strategic placement of the finger slot and thumb aperture and increased surface area is that the user's forearm lays parallel to and over the longitudinal center line of the flat plate, thus providing good balance and lateral stability of the plate as it is moved through the water. The gripping feature also eliminates the need for attached handgrips or wrist straps as required in some prior art devices and allows the plates to have lower cost per unit of drag than any other of the prior art devices.

SUMMARY OF THE INVENTION

It is therefore an object of the present invention to provide a set of generally rectangular flat plates for aquatic exercise that create drag when moved through a body of water to resist muscle contraction or movement, and have a resistive surface area of sufficient size to produce significant drag to offer effective exercise benefits.

It is another object of this invention to provide an aqua therapy system utilizing sets of generally rectangular flat plates which have surface areas of different size to produce resistive forces designed to provide therapeutic beneficial effects of aerobic, anaerobic, and combined exercises.

Another object of this invention is to provide a set of generally rectangular flat plates for aquatic exercise that have an arcuate finger slot for receiving the user's four fingers and an aperture for receiving their thumb, which are strategically located such that when the plate is gripped, the center of the palm of the user's hand lays over the center of the flat plate on one side and the fingers and thumb are folded over to engage the opposite side.

Another object of this invention is to provide a set of generally rectangular flat plates for aquatic exercise that have an arcuate finger slot for receiving the user's four fingers and an aperture for receiving their thumb, which when gripped allows the drag produced by moving the flat plate through the water to be transferred to the center of the flat plate.

Another object of this invention is to provide a set of generally rectangular flat plates for aquatic exercise that have an arcuate finger slot for receiving the user's four fingers and an aperture for receiving their thumb, which allows larger flat plates to be used and provides greater surface area than prior art devices.

Another object of this invention is to provide a set of generally rectangular flat plates for aquatic exercise that have an arcuate finger slot for receiving the user's four fingers and an aperture for receiving their thumb, which when gripped places the user's forearm parallel to and over the longitudinal center line of the flat plate, thus providing good balance and lateral stability of the plate as it is moved through the water.

A further object of this invention is to provide a set of generally rectangular flat plates for aquatic exercise that have an arcuate finger slot for receiving the user's four fingers and an aperture for receiving their thumb, which eliminates the need for attached handgrips or wrist straps as required in some prior art devices.

A still further object of this invention is to provide a set of generally rectangular flat plates for aquatic exercise that have an arcuate finger slot for receiving the user's four fingers and an aperture for receiving their thumb, which are simple in construction, inexpensive to manufacture, and are rugged, reliable and effective in use.

Other objects of the invention will become apparent from time to time throughout the specification and claims as hereinafter related.

The above noted objects and other objects of the invention are accomplished by a set of generally rectangular flat plates for aquatic exercise that create drag when moved through a body of water. Each flat plate is provided with an arcuate finger slot for receiving the user's four fingers and an aperture for receiving their thumb. The finger slot and thumb aperture are strategically located such that when the plate is gripped, the center of the palm of the user's hand lays over the center of the flat plate on one side and the fingers and thumb are folded over to engage the opposite side. This feature allows the drag produced by moving the flat plate through the water to be transferred to the center of the flat plate, and the thumb aperture allows larger flat plates to be used to provide increased surface area. Another additional advantage of the strategic placement of the finger slot and thumb aperture and increased surface area is that the user's forearm lays parallel to and over the longitudinal center line of the flat plate, thus providing good balance and lateral stability of the plate as it is moved through the water. The gripping feature also eliminates the need for attached handgrips or wrist straps as required in some prior art devices and allows the plates to have lower cost per unit of drag than any other of the prior art devices.

DESCRIPTION OF THE PREFERRED EMBODIMENT

Figure 1:
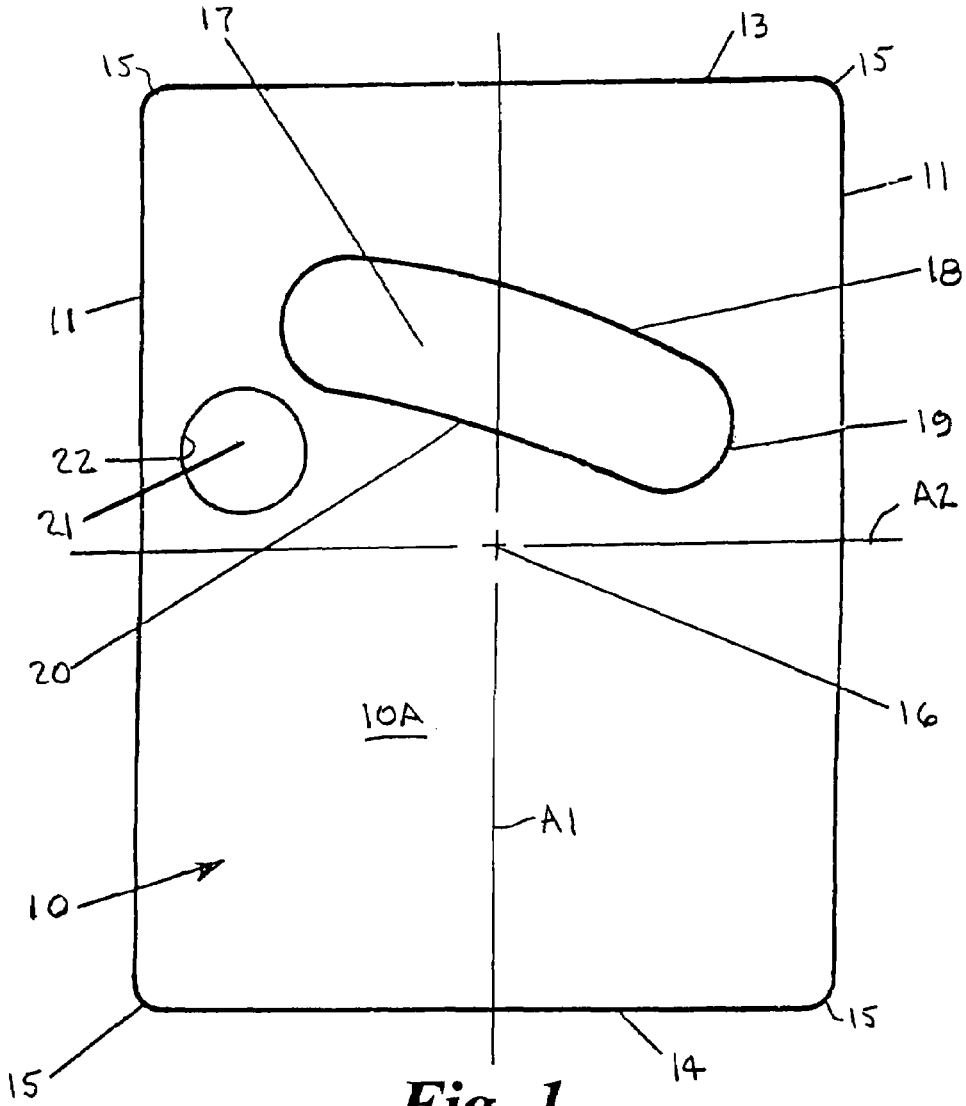
FIG. 1 is a front elevation view of an aquatic exercise plate in accordance with the present invention.
Figure 2:
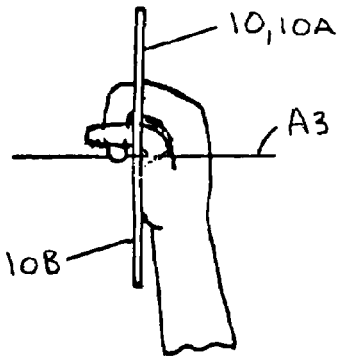
FIG. 2 is a side elevation view of the of the aquatic exercise plate being gripped through the finger slot and thumb aperture by the thumb and fingers of a user.
Figure 3:
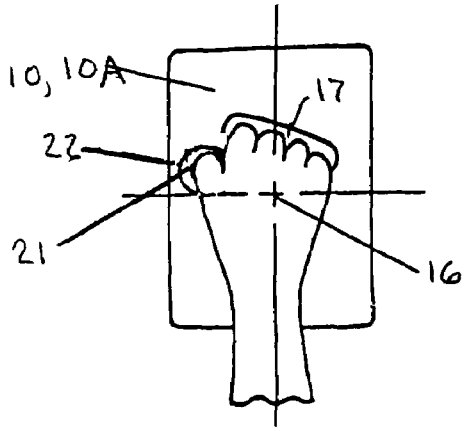
FIG. 3 is an elevation view of the aquatic exercise plate being gripped through the finger slot and thumb aperture by the thumb and fingers of a user.

Referring to the drawings by numerals of reference, there is shown in FIGS. 1, 2 and 3, a first preferred embodiment of an aquatic exercise plate 10. Although only one plate 10 is shown and described, it should be understood that the aquatic exercise plates 10 are provided in pairs for both hands. It should also be understood that both plates 10 of a pair are identical and can be flipped over to be receive the right hand or the left hand of the user. The plate 10 is a flat generally rectangular body having opposing parallel lateral sides 11 and opposing parallel bottom and top ends 13 and 14, respectively, with four rounded corners 15. The body of the flat plate 10 is a flat, smooth surface made of a plastic material that is rigid but will flex slightly when a large force is applied. The body of the flat plate 10 may also be made from a plastic material that floats.

As best seen in FIG. 1, the flat aquatic exercise plate 10 has a longitudinal center axis A1 lying parallel to the lateral sides 11 and an equal distance from each, a transverse axis A2 lying parallel to the top and bottom ends 13 and 14 and an equal distance from each, and a center 16 located where the longitudinal axis A1 and transverse axis A2 intersect.

An arcuate finger slot 17 is formed in the aquatic exercise plate for gripping the flat plate with the fingers of a human hand. The slot 17 has a curved upper edge 18, a rounded pair of ends 19 that oppose each other and a lower edge 20 that is curved to fit a normal human hand with the fingers inserted through the finger slot 17 and the palm of the hand resting against the flat top surface 10A and the fingers engaged on the bottom or underside 10B of the plate.

A thumb aperture 21 is formed in the plate 10 below one end and adjacent to the finger slot 17 through which the thumb of the user is inserted and engaged on the bottom or underside 10B of the plate, as shown in FIGS. 2 and 3. The thumb aperture 21 is shown in FIG. 1 as a circular hole having an interior diameter 22, however, it should be understood that the thumb aperture 21 may be of various other shapes.

As best seen from the side in FIG. 2, the aquatic exercise plate 10 has a perpendicular axis A3 that passes through the center 16 (FIGS. 1 and 3) and is perpendicular to the flat surface of the aquatic exercise plate. The finger slot 17 and thumb aperture 21 are strategically located such that when the plate 10 is gripped by a normal human hand, the center of the palm of the hand will be directly over the intersection of the transverse axis A2 and the longitudinal axis A1 at the center 16 of the plate and the wrist and forearm of the hand will lay over and parallel to the longitudinal axis A1.

Figure 5:
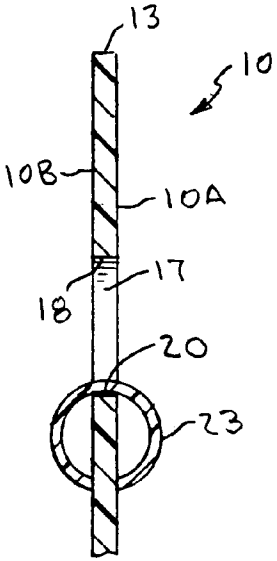
FIG. 5 is a longitudinal cross section taken along line 5-5 of FIG. 4 showing the transversely rounded gripping surface in cross section.
Figure 6:
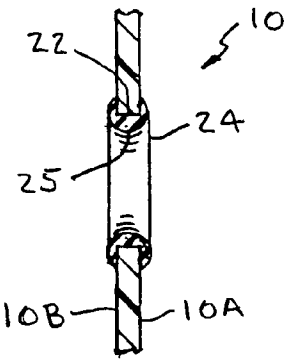
FIG. 6 is a longitudinal cross section taken along line 6-6 of FIG. 4 showing the cushioning insert in cross section.
Figure 4:
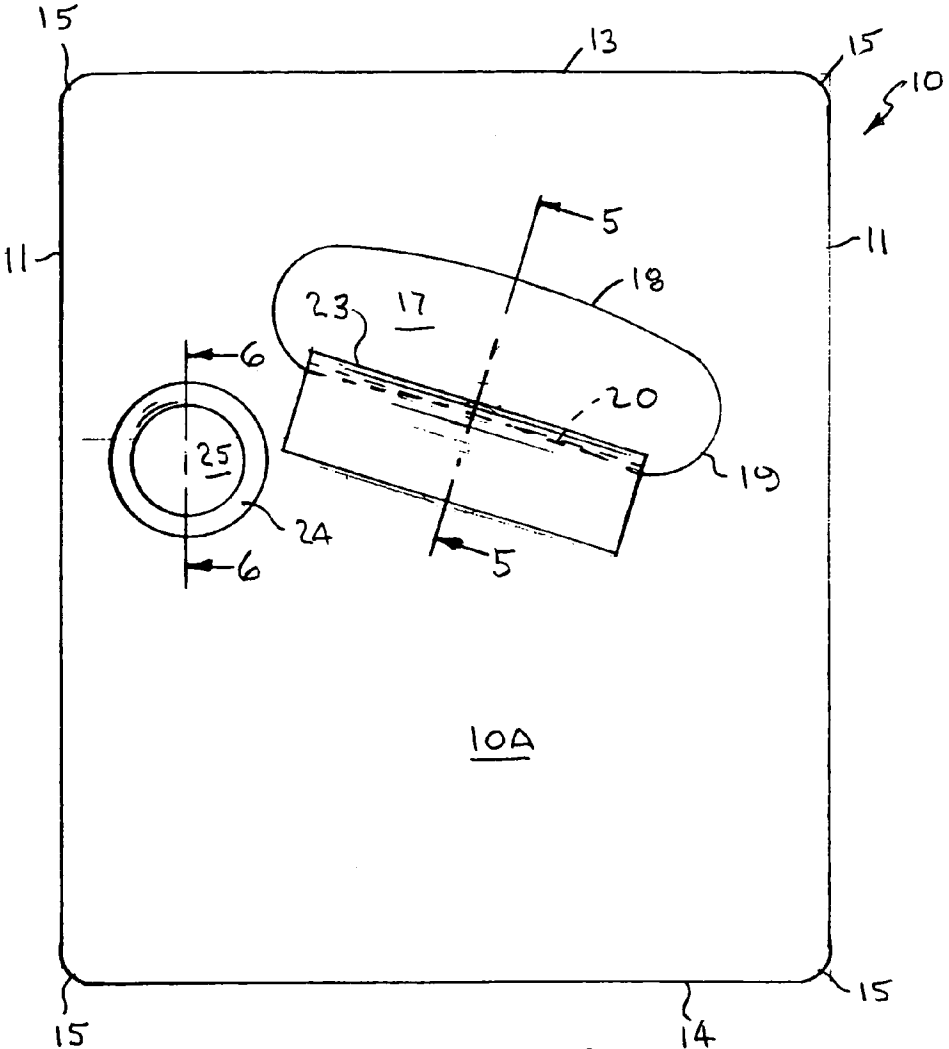
FIG. 4 is a front elevation view of a second embodiment of the exercise plate in accordance with the present invention having a transversely rounded gripping surface and a cushioning insert in, and surrounding, the thumb aperture.

Referring to FIGS. 4, 5 and 6, there is shown a second preferred embodiment of the aquatic exercise plate 10. In the following discussion the structural elements described above are assigned the same numerals of reference, but will not be described again in detail to avoid repetition. In this embodiment, the plate 10 is provided with a transversely rounded gripping surface 23 that extends over and along the lower edge 20 of the slot 17 with the rounded surface facing the interior of the slot. The rounded gripping surface 23 provides a larger surface over which the fingers of the user's hand are folded to provide a comfortable grip and making easier for users having a weak grip or arthritis to grip and maneuver the plates. The plate 10 may also be provided with an insert 24 formed of cushioning material disposed in, and surrounding, the thumb aperture 21, which has a central opening 25 through which the thumb of the user's hand is received. The insert 24 provides a comfortable cushioned aperture to prevent chafing of the user's thumb as the plate is maneuvered in pushing and pulling motions through the water.

It should be understood the lower edge 20 of the slot 17 may be integrally formed to provide a transversely rounded gripping surface, and the thumb aperture 21 may be integrally formed to provide a rounded circumferential surface surrounding the thumb aperture.

The aquatic exercise plates 10, which are provided in pairs for both hands, may be provided in various sizes; for example: small, medium, large, and extra large, with each set of having surface areas of increasingly larger size in a system to produce increasingly larger resistance or drag forces designed to provide therapeutic beneficial effects of aerobic, anaerobic, and combined exercises, as discussed below.

When the flat plate 10 is moved with the palm pushing forward through the water in a direction parallel to the perpendicular axis A3 (FIG. 2), drag is produced over the bottom or underside surface 10B (side on which the fingers are engaged), and the sum of that force is transferred to the palm of the hand resting against the top surface 10A. The center of that force acts along the perpendicular axis A3, which passes through the center 16 of the flat plate where the transverse axis A2 and the longitudinal axis A1 intersect, and through the center of the palm of the user's hand. The perpendicular axis A3 (FIG. 2) passes through the center of the user's palm and the center 16 of the flat plate 10. It can be seen that when the hand of the user pushes the flat plate through the water, the user does not have to grip it, thus allowing the user to exert a great amount of force without discomfort to the hand.

Depending upon the size of the aquatic exercise flat plate, it may contact the forearm of the user while moving it forward through the water. As seen in FIG. 3, the forearm will be engaged on the top surface 10A (palm side) of the flat plate along the longitudinal axis A1. This will provide additional pushing surface contact that is balanced laterally.

The thumb aperture 21 (FIGS. 1 and 3) provides the user with greater control of the flat plate 10 when it's bottom or underside surface 10B is moved through the water along the perpendicular axis A3.

The aquatic exercise plates 10 in accordance with the present invention are provided in pairs for both hands, and may be provided in paired sets of various sizes in an aqua therapy system; for example: small, medium, and large, with each pair having an increasingly larger square surface area to provide increasingly larger resistance or drag force to be used in a balanced exercise program to provide therapeutic beneficial effects of aerobic, anaerobic, and combined exercises, as discussed below.

Aerobic or cardiovascular exercise is complementary to anaerobic exercise. Aerobic literally means "with oxygen", and refers to the use of oxygen in the energy-generating process of muscles. Aerobic exercise includes any type of exercise, typically those performed at moderate levels of intensity for extended periods of time, that maintains an increased heart rate. In such exercise, oxygen is used to "burn" fats and glucose in order to produce adenosine triphosphate, the basic energy carrier for all cells. Initially during aerobic exercise, glycogen is broken down to produce glucose, but in its absence, fat metabolism is initiated instead, which is a slow process and is accompanied by a decline in performance level.

Among the recognized benefits of doing regular aerobic exercise are: strengthening the muscles involved in respiration to facilitate the flow of air in and out of the lungs; strengthening and enlarging the heart muscle to improve its pumping efficiency and reduce the resting heart rate; toning muscles throughout the body which can improve overall circulation and reduce blood pressure; increasing the total number of red blood cells in the body to facilitate transport of oxygen throughout the body; increased storage of energy molecules such as fats and carbohydrates within the muscles, allowing for increased endurance; and neovascularization of the muscle sarcomeres to increase blood flow through the muscles.

Aerobic exercise alone may not provide a well-balanced exercise program, and typically is is not effective for providing muscular strength, especially upper-body muscular strength. Also, the metabolic pathways involved in anaerobic metabolism (glycolysis and lactic acid fermentation) that generate energy during high intensity, low duration efforts are not exercised at peak rates. Aerobic exercise is, however, an extremely valuable component of a balanced exercise programme and is good for cardiovascular health.

Anaerobic means "without oxygen", and refers to the energy exchange in living tissue that is independent of oxygen. This terminology refers to the molecular level of respiration, not the respiration of the organism as a whole (i.e., breathing). Anaerobic exercise, in contrast to aerobic exercise, is brief, high intensity activity or burst of intense exertion, such as weight lifting, sprinting, and jumping. During anearobic exercise anearobic metabolism takes place in the muscles (the glycogen or sugar is consumed without oxygen), and is a far less efficient process. Anaerobic exercise is typically used to build power and muscle mass. Muscles that are trained under anaerobic conditions develop biologically different giving them greater performance in short duration-high intensity activities. During anaerobic exercise, the muscles being exercised have insufficient oxygen to meet the demands of the activity, and thus must also use alternate, non-oxygen-dependent processes to produce energy.

There are two types of anaerobic energy system, the ATP-PCr energy system, which uses creatine phosphate as the main energy source, and the lactic-acid (or anaerobic glycolysis) system that uses glucose (or glycogen) in the absence of oxygen. The latter is an inefficient use of glucose and produces by-products that are thought to be detrimental to muscle function. Anaerobic exercise begins with muscles utilizing stored creatine phosphate to generate the ATP (adenosine triphosphate) that produces muscle contraction. After several seconds, further ATP energy is made available to muscles by metabolizing muscle glycogen into pyruvate through glycolysis, as it normally does through the aerobic cycle. What differs is that pyruvate is fermented to lactic acid, rather than being broken down through the slower but more energy efficient aerobic process. The lactic-acid system is the dominant energy system during high to maximal intensity exercise over short durations, but the lactic acid system can still provide a proportion of the required energy during aerobic exercise, as the body has the capacity to get rid of the anaerobic by-products at a certain rate.

Resistance exercise in an anaerobic exercise similar to weight lifting in that it requires a user to perform repetitions by pushing or pulling against a resistance force and strengthens particular muscle groups.

Hydrodynamic or aquatic exercises is where the person is partially immersed in water and uses the water as a weight or resistance medium. A body that weighs 150 lbs. on land weighs 15 lbs. in the water. Thus, the water provides extra support for persons with back, knee, or joint problems and significantly reduces the detrimental stress on the joints of the person. Water also provides 12 times the resistance of air, so a movement done in the water is 12 times harder than on land and requires more effort.

In an aquatic therapy exercise system for providing therapeutic beneficial effects of aerobic, anaerobic, and combined exercises, the aquatic exercise plates 10 in accordance with the present invention are provided in paired sets, with each pair having an increasingly larger square surface area to provide increasingly larger resistance or drag force.

A first pair of smaller aquatic exercise plates are provided, each having a flat surface area which is sized to provide a resistive drag force sufficient to allow them to be moved relatively easily through the body of water in performing aerobic exercises for respiratory and cardiovascular conditioning. A second pair of intermediate aquatic exercise plates of a second size are provided, each having a flat surface area greater than the surface area of the first pair which is sized to provide a moderate resistive drag force sufficient to require more effort to move them through the body of water than the first pair in performing combined aerobic and anaerobic exercises for respiratory and cardiovascular conditioning, and toning the user's muscles. A third pair of larger aquatic exercise plates of a third size are provided, each having a flat surface area greater than the surface area of the second pair which is sized to provide a heavy resistive drag force sufficient to require more effort to move them through the body of water than the second pair in performing anaerobic exercises for building muscular strength, and muscle mass.

While this invention has been described fully and completely with special emphasis upon preferred embodiments, it should be understood that within the scope of the appended claims the invention may be practiced otherwise than as specifically described herein.

The invention claimed is:

1. An aquatic exercise plate adapted to be gripped in a user's hand and moved through a body of water in pushing and pulling motions in performing exercises to create drag to resist muscle contraction or movement, comprising:

a generally rectangular flat plate formed of stiff material having opposed parallel lateral sides, opposed parallel top and bottom ends, a longitudinal center axis parallel to said lateral sides and an equal distance inward from each, a transverse axis parallel to said top and bottom ends and an equal distance inward from each, and a center flat portion disposed at the intersection of said longitudinal axis and said transverse axis;

an arcuate finger slot formed in said plate for receiving the fingers of the user's hand;

a transversely rounded gripping surface extending along one longitudinal side of said arcuate finger slot over which the fingers of the user's hand are to be folded;

a generally circular thumb aperture formed in said plate below one end and adjacent to said finger slot for receiving the thumb of the user's hand; and a cushioning insert formed of cushioning material disposed in, and surrounding, said thumb aperture having a generally circular central opening for receiving the thumb of the user's hand;

said finger slot and thumb aperture disposed relative to one another and to said center flat portion of said plate such that when said plate is gripped, the center of the palm of the user's hand lays over said center flat portion of said plate on a top side thereof, the user's fingers are received through said finger slot and folded over said gripping surface, the user's thumb is received through said cushioning insert and folded over to engage the underside of said plate, and the user's forearm lays parallel to and over said longitudinal axis of said plate; and drag produced by moving said plate through the body of water in pushing and pulling motions against the resistance force of the water is transferred to said center flat portion of said plate and the center of the drag force passes through the center of the palm of the user's hand.

2. An aquatic therapy exercise system for providing therapeutic beneficial effects of aerobic, anaerobic, and combined exercises, in a body of water, comprising:

a first pair of smaller aquatic exercise plates of a first size, a second pair of intermediate aquatic exercise plates of a second size, and third pair of larger aquatic exercise plates of a third size, each of said plates adapted to be gripped in a user's hand and moved through a body of water in pushing and pulling motions in performing exercises to create drag to resist muscle contraction or movement;

each of said plates comprising a generally rectangular flat plate formed of stiff material having opposed parallel lateral sides, opposed parallel top and bottom ends, a longitudinal center axis parallel to said lateral sides and an equal distance inward from each, a transverse axis parallel to said top and bottom ends and an equal distance inward from each, a center flat portion disposed at the intersection of said longitudinal axis and said transverse axis, an arcuate finger slot formed therein for receiving the fingers of the user's hand with a transversely rounded gripping surface extending along one longitudinal side thereof over which the fingers of the user's hand are to be folded, a generally circular thumb aperture formed in said plate below one end and adjacent to said finger slot with a cushioning insert formed of cushioning material disposed in and surrounding said thumb aperture having a generally circular central opening for receiving the thumb of the user's hand;

said finger slot and thumb aperture disposed relative to one another and to said center flat portion such that when said plate is gripped, the center of the palm of the user's hand lays over said center flat portion of said plate on a top side thereof, the user's fingers are received through said finger slot and folded over said gripping surface, the user's thumb is received through said cushioning insert and folded over to engage the underside of said plate, and the user's forearm lays parallel to and over said longitudinal axis of said plate, whereby drag produced by moving said plate through the body of water in pushing and pulling motions against the resistance force of the water is transferred to said center flat portion of said plate and the center of the drag force passes through the center of the palm of the user's hand;

said first pair of smaller aquatic exercise plates each having a flat surface area sized to provide a resistive drag force sufficient to allow them to be moved relatively easily through the body of water in performing aerobic exercises for respiratory and cardiovascular conditioning;

said second pair of intermediate aquatic exercise plates each having a flat surface area greater than the surface area of said first pair sized to provide a moderate resistive drag force sufficient to require more effort to move them through the body of water than said first pair in performing combined aerobic and anaerobic exercises for respiratory and cardiovascular conditioning, and toning the user's muscles; and said third pair of larger aquatic exercise plates of a third size each having a flat surface area greater than the surface area of said second pair sized to provide a heavy resistive drag force sufficient to require more effort to move them through the body of water than said second pair in performing anaerobic exercises for building muscular strength, and muscle mass.

* * * * *